US009410697B2

(12) United States Patent
Tungl

(10) Patent No.: US 9,410,697 B2
(45) Date of Patent: Aug. 9, 2016

(54) MIXING DEVICE FOR MIXING COMBUSTION AIR AND GAS, AND FIRING DEVICE

(76) Inventor: Rudolf Tungl, Landshut (DE)

( * ) Notice: Subject to any disclaimer, the term of this patent is extended or adjusted under 35 U.S.C. 154(b) by 462 days.

(21) Appl. No.: 13/816,596

(22) PCT Filed: Jun. 22, 2011
(Under 37 CFR 1.47)

(86) PCT No.: PCT/EP2011/060515

§ 371 (c)(1),
(2), (4) Date: Feb. 12, 2013

(87) PCT Pub. No.: WO2012/019818

PCT Pub. Date: Feb. 16, 2012

(65) Prior Publication Data

US 2013/0149654 A1 Jun. 13, 2013

(30) Foreign Application Priority Data

Aug. 13, 2010 (DE) ..... 10 2010 034 255
Sep. 1, 2010 (DE) ..... 10 2010 036 100

(51) Int. Cl.
*F23D 14/02* (2006.01)
*F23D 14/04* (2006.01)
*F23K 5/00* (2006.01)

(52) U.S. Cl.
CPC ..... *F23D 14/04* (2013.01); *F23K 5/007* (2013.01); *F23K 2401/20* (2013.01)

(58) Field of Classification Search
CPC ..... F16L 11/00; F16L 11/15; F16L 9/06; F23K 5/007; Y10S 285/903; Y10T 29/49435; F23D 14/02
USPC ..... 285/148.14, 226, 921; 431/354, 355; 126/39 R
See application file for complete search history.

(56) References Cited

U.S. PATENT DOCUMENTS

| | | | | |
|---|---|---|---|---|
| 282,967 | A * | 8/1883 | Duffy | 285/226 |
| 1,354,419 | A * | 9/1920 | Reppetto | 285/148.12 |
| 1,762,721 | A * | 6/1930 | Klingner | 285/342 |
| 1,912,612 | A * | 6/1933 | Wills | 239/398 |
| 1,978,529 | A * | 10/1934 | Harrah | 285/226 |
| 2,261,361 | A * | 11/1941 | Gerhardt et al. | 432/185 |
| 2,288,684 | A * | 7/1942 | Couty | 285/251 |
| 2,319,586 | A * | 5/1943 | Clench | 285/256 |
| 2,548,904 | A * | 4/1951 | Neal et al. | 60/800 |

(Continued)

FOREIGN PATENT DOCUMENTS

| | | | |
|---|---|---|---|
| DE | 19748570 | A1 | 5/1999 |
| WO | WO-2004/063629 | A1 | 7/2004 |

OTHER PUBLICATIONS

International Preliminary Report on Patentability in corresponding PCT Application No. PCT/EP2011/060515.

(Continued)

*Primary Examiner* — Jorge Pereiro
(74) *Attorney, Agent, or Firm* — Harness, Dickey & Pierce, P.L.C.

(57) ABSTRACT

The invention relates to a mixing device for premixing combustion air and gas, having a gas regulating device and a gas outlet and a nozzle, wherein a gas inlet is provided on the nozzle or on a bridging element disposed on the nozzle, and the gas path from the gas outlet to the gas inlet is sealed off by a gasket extending from the gas outlet to the gas inlet.

15 Claims, 3 Drawing Sheets

(56) References Cited

U.S. PATENT DOCUMENTS

| | | | | | |
|---|---|---|---|---|---|
| 2,582,249 | A | * | 1/1952 | Hendel | 285/226 |
| 2,695,183 | A | * | 11/1954 | Andrew et al. | 285/332.4 |
| 2,896,606 | A | * | 7/1959 | Ross et al. | 126/38 |
| 3,008,738 | A | * | 11/1961 | Longfellow | 285/329 |
| 3,017,203 | A | * | 1/1962 | MacLeod | 285/256 |
| RE25,653 | E | * | 10/1964 | Longfellow | 285/329 |
| 3,169,785 | A | * | 2/1965 | Ziebold | 285/226 |
| 3,251,393 | A | * | 5/1966 | Beach et al. | 431/3 |
| 3,530,900 | A | * | 9/1970 | Kish | 138/109 |
| 3,574,354 | A | * | 4/1971 | Mischel | 285/16 |
| 3,606,608 | A | * | 9/1971 | Miller et al. | 431/121 |
| 3,692,337 | A | * | 9/1972 | Mischel | 285/226 |
| 3,714,966 | A | * | 2/1973 | Zobler et al. | 137/560 |
| 3,743,328 | A | * | 7/1973 | Longfellow | 285/226 |
| 3,909,186 | A | * | 9/1975 | Kidwell et al. | 431/254 |
| 3,970,334 | A | * | 7/1976 | Campbell | 285/30 |
| 4,082,327 | A | * | 4/1978 | Sting et al. | 285/401 |
| 4,111,464 | A | * | 9/1978 | Asano et al. | 285/111 |
| 4,142,554 | A | * | 3/1979 | Washkewicz et al. | 138/125 |
| 4,733,890 | A | * | 3/1988 | Vyse | 285/148.14 |
| 4,817,997 | A | * | 4/1989 | Ingram | 285/256 |
| 4,909,547 | A | * | 3/1990 | Guy | 285/148.28 |
| 5,015,014 | A | * | 5/1991 | Sweeney | 285/81 |
| 5,165,727 | A | * | 11/1992 | Valley | 285/12 |
| 5,316,350 | A | * | 5/1994 | Kollenbrandt et al. | 285/242 |
| 5,346,138 | A | * | 9/1994 | Ridenour | 239/600 |
| 5,360,242 | A | * | 11/1994 | Argent | 285/330 |
| 5,370,427 | A | * | 12/1994 | Hoelle et al. | 285/301 |
| 5,397,157 | A | * | 3/1995 | Hempel et al. | 285/227 |
| 5,462,431 | A | * | 10/1995 | Ahmady | 431/43 |
| 5,538,294 | A | * | 7/1996 | Thomas | 285/55 |
| 5,766,003 | A | * | 6/1998 | Vogelzang | 432/222 |
| 5,904,378 | A | * | 5/1999 | Bakker et al. | 285/55 |
| 5,921,591 | A | * | 7/1999 | Argent | E21B 17/0426 228/135 |
| 5,934,269 | A | * | 8/1999 | Wilson | 126/512 |
| 5,941,232 | A | * | 8/1999 | Vogelzang | 126/110 B |
| 6,095,133 | A | * | 8/2000 | Walters | 126/41 R |
| 6,116,289 | A | * | 9/2000 | Hayashi | 138/122 |
| 6,244,223 | B1 | * | 6/2001 | Welk | 122/13.01 |
| 6,308,992 | B1 | * | 10/2001 | Mitsui et al. | 285/239 |
| 6,860,518 | B2 | * | 3/2005 | Krauss et al. | 285/206 |
| 7,237,547 | B1 | * | 7/2007 | Bourgeois | 126/9 R |
| 7,513,247 | B2 | | 4/2009 | Clauss et al. | |
| D612,915 | S | * | 3/2010 | McPheat | D23/262 |
| 7,896,748 | B2 | * | 3/2011 | Muskus et al. | 464/79 |
| 8,136,845 | B2 | * | 3/2012 | Patel | F16L 25/12 285/236 |
| 8,523,242 | B2 | * | 9/2013 | Hosotani et al. | 285/239 |
| 2002/0001786 | A1 | | 1/2002 | Haynes et al. | |
| 2003/0099799 | A1 | * | 5/2003 | Koike et al. | 428/36.91 |
| 2004/0209212 | A1 | * | 10/2004 | Schmidt | 431/159 |
| 2004/0222626 | A1 | | 11/2004 | Baruh | |
| 2004/0239109 | A1 | * | 12/2004 | Angus | 285/226 |
| 2006/0016444 | A1 | | 1/2006 | Clauss et al. | |
| 2007/0216157 | A1 | * | 9/2007 | Tarquini | 285/256 |
| 2008/0106097 | A1 | * | 5/2008 | Homrich | 285/382 |
| 2009/0072494 | A1 | | 3/2009 | Smith | |
| 2010/0037629 | A1 | * | 2/2010 | Voorhis | 62/56 |

OTHER PUBLICATIONS

International Search Report and Written Opinion of the ISA for PCT/EP2011/060515, ISA/EP, Rijswijk, NL, mailed Oct. 14, 2011.

* cited by examiner

MIXING DEVICE FOR MIXING COMBUSTION AIR AND GAS, AND FIRING DEVICE

CROSS-REFERENCE TO RELATED APPLICATIONS

This application is a 371 U.S. National Stage of International Application No. PCT/EP2011/060515, filed Jun. 22, 2011, which claims priority to German Patent Applications Nos. 10 2010 034 255.6, filed Aug. 13, 2010 and 10 2010 036 100.3, filed Sep. 1, 2010. The disclosures of the above applications are incorporated herein by reference.

The invention relates to a mixing device for premixing combustion air and gas, comprising a device having a gas outlet for gas introduction and comprising a nozzle, a gas inlet being provided on the nozzle or on a bridging element arranged on the nozzle, and the gas path from the gas outlet to the gas inlet being sealed off by a gasket extending from the gas outlet to the gas inlet. The invention further relates to a firing device, comprising a gas burner having a combustion chamber, comprising a fan, and comprising a mixing device, the mixture of combustion air and gas supplied by the mixing device being introduced to the combustion chamber of the gas burner by means of the fan.

PRIOR ART

Mixing devices for mixing gas and combustion air are known from the prior art. For example, DE 10 2005 007 123 B3 discloses a mixing unit formed from a gas regulating device and a Venturi nozzle, in which a gas outlet connector of the gas regulating device is inserted into a corresponding recess of the housing of the Venturi nozzle so as to ensure a gas-tight connection between the two components. The gas regulating device and the Venturi nozzle are rigidly interconnected. The possible tolerances of the individual components are thus very low. However, it would be desirable to be able to provide a more flexible connection option so as to ensure a greater freedom of configuration in the arrangement of the various components.

OBJECT OF THE INVENTION

Accordingly, the object of the present invention is to provide a mixing device which is simple to assemble and in which the gas regulating device and the nozzle are interconnected in a gas-tight manner, but with the possibility of tolerance compensation, and thus not necessarily directly and rigidly.

Achieving the Object

The present object is achieved by a mixing device having the features of claim 1. According to the invention, a gas inlet is provided on the nozzle or on a bridging element arranged on the nozzle, and the gas path from the gas outlet to the gas inlet is sealed off by a gasket extending from the gas outlet to the gas inlet. In a development, a gas inlet connector may be provided on the nozzle or on a bridging element to the nozzle, a gasket being provided which forms a tight seal on the outside or inside of the gas inlet connector over a predetermined axial length and seals off the gas path from the gas outlet to the nozzle or the bridging element. In this context, a gas regulating device may be used as a device for gas introduction. Alternatively, the gas regulator may also be arranged on the nozzle or upstream from the gas valve, and the device for gas introduction may be a (safety) gas valve.

A gas inlet is understood to mean any construction to which a gasket can be applied, it also being possible to form a gas inlet connector of a corresponding construction as a wall on the inside of the nozzle or the bridging element. The feature "gas regulating device" is defined as any device which is suitable for making the gas provided by the gas line available in the desired amounts. A "nozzle" should be understood to mean any component which mixes flows of combustion air and gas inside a housing; this means that mixing devices in general are included, even those without a "nozzle function". A "gas path" is understood to mean the flow path of the gas. The "gas outlet" is defined by a region in which the gas leaves the gas regulating device or the gas valve. Although only embodiments comprising gas regulating devices are disclosed in the following, it will be appreciated that the gas valve may also be used for this purpose in all of the embodiments. In this case, the amount of gas is regulated for example at the nozzle.

So as to increase the flexibility of the arrangement of the various components and to ensure a high level of tolerance compensation, in a preferred development the gas inlet connector may be arranged on the nozzle indirectly via a bridging element. It is thus unnecessary to form the gas inlet connector directly on the nozzle, and instead, the bridging element may take on any desired form and bridge any distance between the gas regulating device and the nozzle. In a preferred embodiment, the gas inlet connector projects outwards past an edge plane of the nozzle or the bridging element, in such a way that the gasket can be applied to the outside or inside of the connector. In the present document, "projecting outwards" should be understood to mean any construction of the connectors in which a portion of the respective connector projects past an edge plane of the component on which the connector is arranged. If a bridging element is used, a gas path is provided from the gas regulating valve to the nozzle, it being possible to arrange the gas inlet connector on the bridging element in such a way that said connector extends substantially flush with the gas outlet connector of the gas regulating valve and projects axially from an edge plane of the bridging element. As a result of using a bridging element, the gas regulating device and the nozzle can be arranged at different vertical levels and thus mutually independently, making the freedom of configuration in the arrangement of the various components more flexible and increasing the tolerance compensation.

The invention comprises the possible alternatives of selectively either providing an additional gas outlet connector on the gas regulating device, which connector is enclosed at least in portions by the gasket, or forming the gas outlet on the gas regulating device as an outlet opening and attaching the gasket in a sealing manner to the inside of the gas outlet. In an embodiment in which the gasket is attached to the inside of the gas outlet, the gas outlet connector is omitted, and production costs and assembly time are reduced. The gasket may be arranged selectively on either the outside or the inside of the gas inlet or gas inlet connector.

In an embodiment comprising two connectors, the gas outlet connector and the gas inlet connector may each be configured to be substantially tubular and with substantially identical diameters, in such a way that the gasket can lie flat on the respective connector and enclose it. In a favourable embodiment of this type, the gasket of fixed diameter exerts substantially identical forces on the outer surfaces of the connectors. However, "substantially tubular" also includes oval constructions. Further, one connector may be oval and formed with a larger internal cross-section than the opposite tubular connector.

Preferably, the gas outlet and gas inlet connectors are arranged in such a way that the respective mutually facing axial outer edges thereof are at a distance, the distance preferably being between 0.5 and 3 mm, more preferably between 1 and 2 mm, most preferably 1 mm. In the present document, "axial" is generally defined as the direction in which the gas outlet connector and the gas inlet connector face one another; for a tubular construction of the connectors, "axial" would thus be the axial longitudinal direction of the tube. Alternatively, even large distances of several centimeters may be provided, for example if the bridging element is formed by the gasket itself. The spacing of the outer edges makes possible a flexible arrangement of the components, which is formed substantially flush as regards the connectors but need not necessarily be fixed exactly. Some offset between the connectors can be compensated as a result of the resilience of the gasket. However, the spacing of the connectors is selected to be as small as possible, in such a way that the gas flow from the gas outlet or gas outlet connector into the inlet connector remains substantially unaffected. In one favourable arrangement, the connectors may be arranged abutting one another, so as to achieve the best possible result in terms of flow whilst providing radial freedom of movement.

In an alternative embodiment, an offset which can be compensated by the gasket may be provided deliberately between the gas outlet or gas outlet connector and the gas inlet connector. For this purpose, the gasket may be in the form of a preformed gasket, which compensates the corresponding offset of several centimeters. Smaller tolerances are additionally possible as a result of the resilience of the gasket material, preferably silicone, NBR or EPDM. Aside from the resilience, these substances have the necessary advantage of being gas-proof.

To attach the gasket to the connectors or to the gas inlet connector and the gas outlet, a simple adhesive connection may be provided between the outer surfaces of the connectors and the inside of the gasket or between the inner surface of the gas outlet and the gas inlet connector and the outer surfaces of the gasket. In a preferred embodiment, the outwardly projecting portions of the connectors comprise external lamellae or an external thread, in which corresponding recesses of the gasket on the inside thereof or an internal thread can engage. If the gasket is arranged on the inside, the lamellae or thread may correspondingly be provided on the inside of the gas outlet or the gas inlet connector. This type of attachment is advantageous because it prevents the gasket from slipping, whilst at the same time ensuring high gas-tightness with a releasably attached gasket. Attachment using lamellae on the connectors and corresponding recesses on the gaskets means that the gas-tightness is even ensured at a plurality of contact points between the connectors and the gasket. The respective projecting portion of the connectors may be between 4 and 50 mm long, in a preferred embodiment between 25 and 30 mm long, so as to ensure a sufficient contact area to ensure the gas-tightness between the gasket and the connectors.

In a development, the axial length of the gasket may be greater than the length to be bridged between the gas regulating device and the nozzle or bridging element, in such a way that the axially central region of the gasket forms a bulge. This additional material of the gasket in the axial direction ensures the possibility of compensating any movements of the gas regulating device relative to the nozzle or the bridging element, in such a way that a seal is ensured even if the connectors are not arranged precisely flush. The axial length of the gasket may further be configured in such a way that at least one, but preferably both of the axial end portions of the gasket lie against the respectively adjacent component (gas regulating device, nozzle, bridging element). In this way, additional sealing surfaces are provided in the radial direction, and moreover the gasket is always deformed in the axial direction, preventing it from being released unintentionally.

In one embodiment of the invention, the gas outlet connector may be releasably attached to the gas regulating device, and the gas inlet connector may be releasably attached to the nozzle or the bridging element, or alternatively the connectors may also be an integral component of these units. The releasable arrangement may for example be provided by way of a screw connection. Said screw connection is advantageous in terms of ease of assembly, since the individual components can be prepared and assembled mutually independently. An integral construction, for example in that the respective connector is extruded directly onto the component by injection moulding, makes the assembly faster, since no additional steps are required for attaching the connector to the respective unit.

In a development of the invention, a shutter which limits the amount of gas flow may additionally be arranged in the gas path from the gas regulating device to the nozzle or the bridging element. As well as natural gases, liquefied gases may also be provided by gas regulating devices. For example, in new buildings the heating system is often installed very early in the construction process, in such a way that liquefied gas can be burnt initially and natural gas only subsequently. However, liquefied gas is sufficiently calorific that the amount supplied via the gas regulating device has to be limited. One solution would be to set up the gas regulating device in a correspondingly complex manner, but the installer would require specialist knowledge for this purpose. Therefore, according to the invention, a shutter which is of a reduced cross section and thus limits the flow of gas in a predefined manner is provided in the gas path. In the case of conversion to natural gas, the shutter can easily be removed again. In the case of screw or plug-in connections between the gas regulating device and the nozzle, such as are used in the state of the art, it is not possible to introduce an additional component, which does not have to be matched in detail to the dimensions of the components used, in such a simple manner. It is also particularly favourable that the shutter can be enclosed externally by the gasket, in such a way that the gas path can be sealed in this region using a single gasket and the sealing surfaces thereof at the gas outlet and the gas inlet connector. For this purpose, the shutter may be laid in, linked in or injected in advance into the gasket. In a form which is easy to operate, the shutter is in the shape of a disc comprising an internal hole, which can be arranged in any desired direction inside the gasket. The shutter may be included in the gas regulating device at the initial installation, so as to be able to provide conversion to liquefied gas in a simple, cost-effective manner with rapid assembly. The installer does not require any specialist knowledge.

In an alternative embodiment, the gasket may be formed with a projection, which can press against a flange portion of the shutter and thus fix it in place in the gas inlet connector when said gasket is installed. The gas inlet into the nozzle is thus clearly defined. The shutter is arranged rigidly in the components, and can be inserted into the gas inlet connector or the gasket in advance for simpler installation. Manipulation is thus made even simpler for the installer.

In one favourable embodiment, the gas regulating device and the nozzle are held on a retaining device in such a way that the gasket remains unaffected by external forces during operation of the firing device. According to the invention, the gas regulating device and the nozzle are attached to the holding device, for example a frame construction, and orientated in such a way that the connectors are substantially flush. Once the gasket has been arranged, manual orientation of the connectors is sufficient before the respective units are fixed rigidly to the holding means.

Claim 16 further defines the firing device which comprises a mixing device according to the invention.

The measures specified above can be tested retrospectively, for example by measuring using calipers.

Other advantageous developments of the invention are characterised in the subordinate claims, or disclosed in greater detail in the following in connection with the description of the preferred embodiment of the invention by way of the drawings. In the drawings, which are exemplary and schematic and not necessarily to scale:

Figure 1:
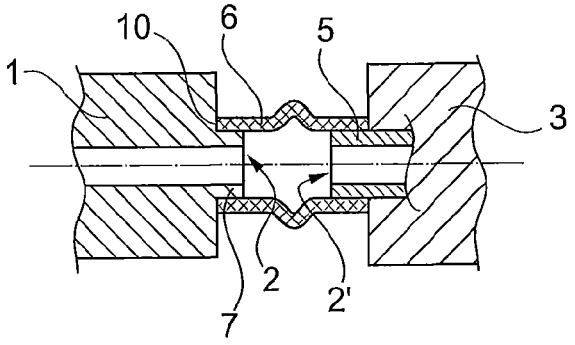
FIG. 1 is a sectional view of the transition from the gas outlet to the nozzle.

FIG. 1 is a detailed view of the mixing device according to the invention, in which a gas regulating device 1 and a nozzle 3, in particular a Venturi nozzle, are provided. On the path to the burner, the gas, of which a predetermined amount is provided from the gas regulating device or the gas valve 1 (only referred to as a gas regulating device in the following), is premixed with ambient air in the nozzle 3. At the gas outlet 2, the gas regulating device 1 comprises a tubular gas outlet connector 7 which is integrated into the gas regulating device 1 and which projects outwards towards the nozzle 3 in the axial direction. A gas inlet 2' in the form of a gas inlet connector 5 is provided on the nozzle 3, and projects outwards past an edge plane of the nozzle 3 in the axial direction. The gas inlet connector 5 is screwed into the nozzle 3 and is thus releasably attached thereto. Alternatively, the gas inlet connector 5 may be integrated into the nozzle 3 in a single piece. A gasket 6 is further provided and encloses in a sealing manner the gas outlet connector 7 and the gas inlet connector 5 from the outside over a predetermined axial length and seals off the gas path from the gas outlet 2 of the gas regulating device 1 to the nozzle 3. The connectors 5, 7 may have a smooth surface, in such a way that the gasket 6 can be slid on easily. No additional attachment of the gasket 6 is necessary, since the fixed positioning of the gas regulating device 1 and the nozzle 3 means that no external forces act on the gasket 6. In the example shown, the connectors 5, 7 are at an axial distance, so as to ensure the largest possible tolerance compensation of the components with respect to one another. The axial length of the gasket 6 is greater than the distance between the gas regulating device 1 and the nozzle 3, in such a way that the gasket forms a bulge 11. This additional material ensures simple assembly, and moreover an edge contact face 10 of the axial end portions of the gasket 6 is brought into contact with the gas regulating device 1 and the nozzle 3. As well as a secure attachment, this results in additional sealing at the radially extending faces. The gasket 6 may additionally be attached to the connectors 5, 7 using an adhesive.

Figure 2:
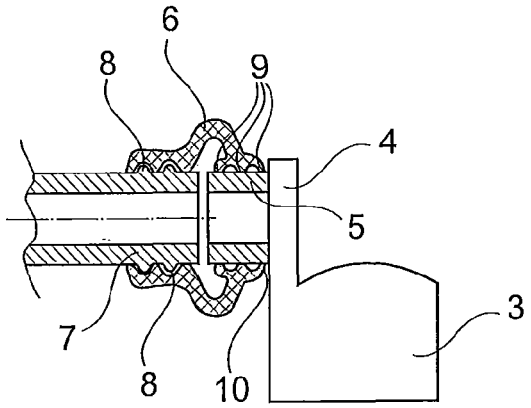
FIG. 2 is a sectional view of the transition from the gas outlet to a bridging element.

FIG. 2 shows an alternative arrangement in which the gas inlet connector 5 is arranged on a bridging element 4, which is directly connected to the nozzle 3. The connectors 5, 7 are shown a small distance apart in the axial direction, but may also be connected so as to abut one another. In each case, the gasket 6 is slid onto the outside over the outwardly projecting portions of the connectors 5, 7. The axial end portion of the gasket 6 contacts the bridging element 4 in such a way that axial edge contact faces 10 are ensured. In the region of the gas inlet connector 5, the axial end portion of the gasket 6 comprises a plurality, three in the example shown, of mutually axially spaced contact faces 9, which are formed in that two recesses extend over the entire inner surface of the gasket. This ensures three-stage sealing in the axial direction by way of three sealing faces. The outwardly projecting part of the gas outlet connector 7 comprises lamellae 8, in which corresponding recesses on the inside of the gasket 6 engage. The gasket 6 is slid over the lamellae 8 in such a way that a locking connection having sealing contact faces 9 is ensured between the lamellae 8 and the recesses of the gasket 6. Only two lamellae 8 are schematically shown in the drawing, but the connection may also comprise a large number of lamellae of this type and a corresponding large number of recesses. In the embodiment shown, the gas outlet connector 7 and the gas inlet connector 5 are each configured to be tubular with identical diameters, in such a way that the gas path from the gas regulating device 1 to the bridging element 4 or nozzle 3 is favourable in terms of flow.

Figure 3:
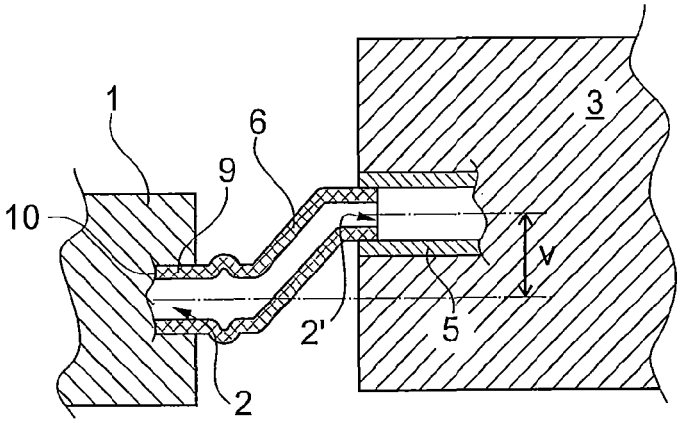
FIG. 3 is a sectional view of a transition from the gas outlet to the nozzle having a lateral offset.

FIG. 3 shows another alternative embodiment, in which the gasket 6 is attached in a sealing manner to the inside of the gas outlet 2 of the gas regulating device 1. A ¾-inch threaded connection is used for the attachment, it being possible to screw the gasket 6 into the gas outlet opening of the gas regulating device until the axial end thereof abuts against the gas regulating device and forms a radial sealing face 10 in addition to the sealing by way of the thread. The gas inlet connector 5 at the gas inlet 2', which may be arranged as desired on a bridging element 4 or a nozzle 3, is at a radial distance (offset) v from the gas outlet 2. The distance v may be several cm, in such a way that the gasket 6 is in the form of a preformed gasket, which bridges the distance v by way of an oblique portion and is connected directly to the gas inlet connector 5. If the orientation of the gasket 6 with respect to the nozzle 3 is not correct, the gasket 6 can be rotated over the thread until it fits axially in the gas inlet connector 5 of the nozzle 3. The axial end portion of the gasket 6 is attached in a sealing manner to the inside of the gas inlet connectors 5, it being possible to select one of the above-disclosed lamellae, threads or adhesive connections.

Figure 4:
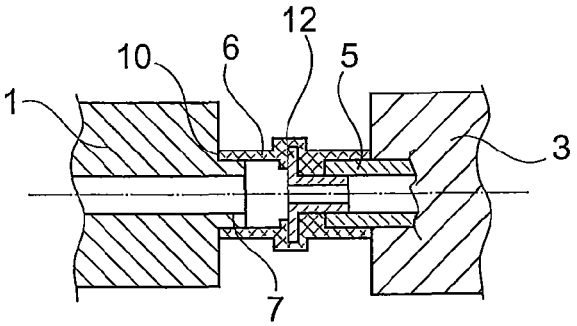
FIG. 4 is a sectional view of a transition comprising a shutter.

FIG. 4 shows a development of the invention in which a shutter 12 is arranged in the gas path from the gas regulating device 1 to the nozzle 3 and is of a reduced cross-section by comparison with the connectors 5, 7. The shutter is enclosed externally by the gasket 6. In the embodiment shown, the shutter 12 is inserted into the gas inlet connector 5, but it may also be configured to be shorter and to be held exclusively by the gasket 6. The flange portion of the shutter 12 is linked into a recess in the gasket 6. Otherwise, the features correspond to the above-disclosed embodiments, in particular to FIG. 1.

Figure 5:
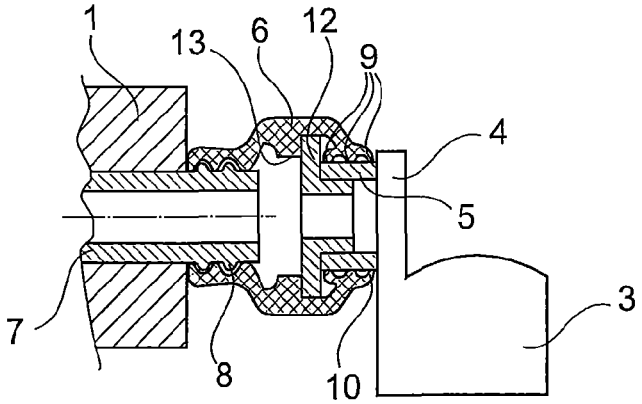
FIG. 5 is a sectional view of an alternative embodiment of a transition comprising a shutter.

FIG. 5 discloses an alternative embodiment of the arrangement of a shutter 12, in which the gasket 6 is formed with a projection 13, which presses against the flange portion of the shutter 12 and thus fixes said shutter to the gas inlet connector 5 of the bridging element 4 (or nozzle 3). The part of the shutter 12 opposing the flange portion is inserted into the gas inlet connector 5. The external sealing of the transition to the connectors and the remaining features correspond to those of the above embodiments.

Figure 6:
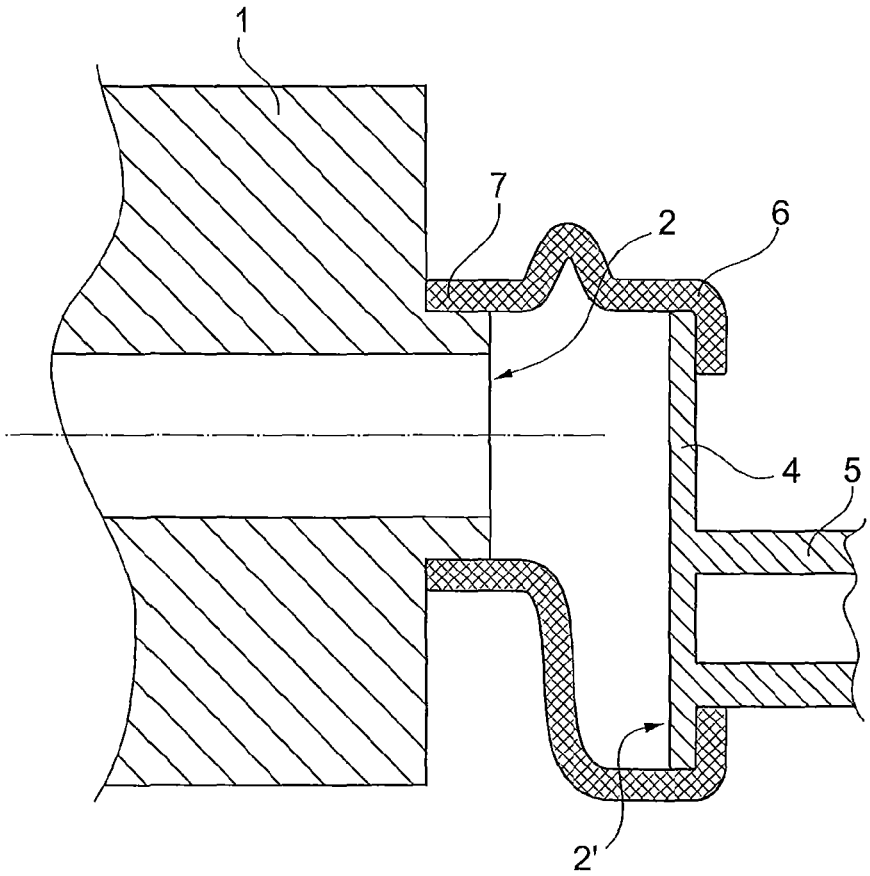
FIG. 6 is a sectional view of an alternative embodiment of a transition from the gas outlet to a bridging element.

FIG. 6 shows an alternative embodiment of the solution according to FIG. 2, in which the gasket 6 is arranged on the gas regulating device 1 according to FIG. 1. The bridging element 4 is not in the form of a direct connector, but forms a bridge from the gas outlet 2 of the gas regulating device to the gas inlet 2' of the bridging element 4, as in the above embodiments, the nozzle 3 (not shown, but as in embodiment according to FIG. 5) being in a direct flow connection to the bridging element 4. The gasket 6 encloses the bridging element 4 on both sides, the respective ends of the gasket 6 engaging around the outer edges of the bridging element 4. The gasket is asymmetrical, and thus ensures an arrangement over the entire outer edge of the bridging element 4. The gas path from the gas outlet 2 to the gas inlet 2' is thus formed and sealed entirely by the gasket 6 in this embodiment too.

In all of the embodiments, the gas regulating device 1 and the nozzle 3 are arranged on a holding device (not shown) in such a way that the gasket 6 is unaffected by external forces and tensions after assembly.

The invention further includes a firing device, comprising a gas burner having a combustion chamber, comprising a fan, and comprising a mixing device which comprises the disclosed gas regulating device and the disclosed nozzle and the corresponding connection of the components.

The configuration of the invention is not limited to the preferred embodiments specified above. Rather, a number of variants which make use of the disclosed solution is conceivable, even if the configurations are fundamentally different in nature. For example, the gasket may be glued to a connector as well as being locked by way of lamellae. As a general rule, the features which are disclosed for one embodiment can also be used in other embodiments whenever this is technically possible. For example, a lamella connection according to FIG. 2 can also be used in the embodiment according to FIG. 1. Further, the gasket could also be provided on the inside of the connectors in the embodiment according to FIG. 2. Also, each of the connectors 5, 7 may be integrated into or attached releasably to the respective component, even if this is not explicitly shown in the drawings. All of the embodiments also include the possibility of the gas inlet connector 5 being formed by the inner wall of the nozzle 3 or the bridging element 4.

The invention claimed is:

1. A mixing device for premixing combustion air and gas, comprising a gas regulating device or a gas valve for gas introduction having a gas outlet and a nozzle, wherein a gas inlet is provided on the nozzle or on a bridging element arranged on the nozzle, a gas path from the gas outlet to the gas inlet is sealed off by a gasket extending from the gas outlet to the gas inlet, a gas inlet connector is provided on the nozzle or the bridging element arranged on the nozzle, and the gasket forms a tight seal on an outside of the gas inlet connector over a predetermined axial length;

a gas outlet connector is provided on the gas regulating device or the gas valve and is enclosed externally at least in portions by the gasket;

the gas outlet connector is releasably attached to the gas regulating device or the gas valve and the gas inlet connector is releasably attached to the nozzle or the bridging element;

at least an outwardly projecting portion of each of the gas outlet connector and the gas inlet connector is provided with lamellae which corresponding recesses of the gasket engage to form the tight seal between the gasket and the respective connector;

the gas outlet connector and the gas inlet connector are arranged in such a way that a respective mutually facing axial outer edge thereof are at a distance between 0.5 and 3 mm; and the gasket includes a recess formed in an inner wall of the gasket, the recess fixes a shutter located in the recess and the gas inlet connector.

2. The mixing device according to claim 1, wherein the gas inlet connector projects outwards in an axial direction, and the gas outlet connector and the gas inlet connector are each configured to be substantially tubular in shape with substantially identical diameters.

3. The mixing device according to claim 1, wherein the gasket can be slid onto respective outwardly projecting portions of the gas outlet connector and the gas inlet connector.

4. The mixing device according to claim 1, wherein at least axial end portions of the gasket comprise at least two mutually axially spaced contact faces.

5. The mixing device according to claim 1, wherein an axial length of the gasket is greater than the length to be bridged between the gas regulating device or the gas valve and the nozzle or bridging element, in such a way that the gasket forms a bulge.

6. The mixing device according to claim 1, wherein at least one of axial end portions of the gasket lies against the gas regulating device or the gas valve and/or the nozzle or the bridging element.

7. The mixing device according to claim 1, wherein the gasket is an elastomeric component arranged in the gas path from the gas outlet to the nozzle or the bridging element.

8. The mixing device according to claim 1, wherein the gasket comprises at least one projection which fixes the shutter in the recess and in the gas inlet connector.

9. The mixing device according to claim 1, wherein the gas regulating device or the gas valve and the nozzle are held on a holding device in such a way that the gasket is arranged so as to be unaffected by external forces.

10. A firing device, comprising a gas burner having a combustion chamber, comprising a fan, and comprising the mixing device according to claim 1, wherein the mixture of combustion air and gas supplied by the mixing device can be introduced to the combustion chamber of the gas burner by means of the fan.

11. The mixing device according to claim 1, wherein the gasket directly contacts the outside surface of the gas inlet connector and directly contacts an outside surface of the gas outlet connector.

12. The mixing device according to claim 11, wherein the gasket is a single piece component.

13. The mixing device according to claim 1, wherein the lamellae includes at least two lamellae.

14. The mixing device according to claim 1, wherein the gasket is a single piece component which extends the entire distance between the gas inlet connector and the gas outlet connector.

15. The mixing device according to claim 1, wherein a threaded connection is not used to connect the gasket to the gas inlet connector or to the gas outlet connector.

* * * * *